US006467721B1

(12) United States Patent
Kautzsch et al.

(10) Patent No.: US 6,467,721 B1
(45) Date of Patent: Oct. 22, 2002

(54) PROCESS FOR THE TARGET-RELATED CORRECTION OF A BALLISTIC TRAJECTORY

(75) Inventors: Karl Kautzsch, Schwanstetten; Jurgen Leininger, Hersbruck; Jurgen Wittmann, Nurnberg; Albrecht Reindler, Weissenohe, all of (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 09/716,089

(22) Filed: Nov. 17, 2000

(30) Foreign Application Priority Data

Nov. 29, 1999 (DE) ..... 199 57 363

(51) Int. Cl.[7] ..... F41G 7/30; F41G 7/00

(52) U.S. Cl. ..... 244/3.11; 244/3.1; 244/3.14; 244/3.24; 342/357.06; 701/213

(58) Field of Search ..... 244/3.1–3.14, 244/3.24–3.3, 3.21; 701/213, 214; 102/384, 385, 386, 387, 388; 342/357.01–357.17

(56) References Cited

U.S. PATENT DOCUMENTS

| | | | | | |
|---|---|---|---|---|---|
| 3,759,466 | A | * | 9/1973 | Evers-Euterneck | 244/3.21 |
| 4,561,357 | A | * | 12/1985 | Maudal et al. | 244/3.11 X |
| 4,566,656 | A | * | 1/1986 | Maudul et al. | 244/3.11 |
| 4,655,411 | A | | 4/1987 | Franzen et al. | |
| 4,726,543 | A | | 2/1988 | Stressen | |
| 5,131,602 | A | * | 7/1992 | Linick | 244/3.14 |
| 6,186,441 | B1 | * | 2/2001 | Schneidereit | 244/3.11 |

FOREIGN PATENT DOCUMENTS

| | | | | |
|---|---|---|---|---|
| DE | 36 08 109 | A1 | 9/1987 | |
| DE | 19718947 | A1 | 11/1998 | |
| DE | 19740888 | A1 | 3/1999 | |
| EP | 138 942 | B1 | 5/1985 | |
| EP | 0519315 | A1 | 6/1992 | |
| EP | 840 393 | A2 | 5/1998 | |
| WO | WO98/1719 | A1 | 1/1998 | |
| WO | WO-00/62008 | A1 * | 10/2000 | F42B/10/48 |

* cited by examiner

*Primary Examiner*—Bernarr E. Gregory
(74) *Attorney, Agent, or Firm*—Scully, Scott, Murphy & Presser

(57) ABSTRACT

In order to perceptibly reduce the inevitable trajectory scatter or spread of ballistically fired projectiles in the target area without the technological expenditure involved in automatic target-seeking control, and in order thereby substantially to improve the level of target hit accuracy, the minimum trajectory path is laid through the previously ascertained target position, having regard to the error budget of the weapon and the external influencing parameters to be expected so that all real trajectories up to the maximum trajectory of that overall error budget are behind the target position. The descent of the projectile into the target area is then shortened from the real trajectory to the minimum trajectory, that is to say towards the target position. For that purpose, attainment of the optimum initialisation point, which is dependent on the theoretical remaining flight time, for the aerodynamic braking device on the projectile is determined on the real trajectory by a procedure whereby the real trajectory is continuously measured by means of satellite navigation, and the approach to the point of intersection with the triggering curve, that is to say the sequence of optimum initialisation points for the array of real trajectories, is established in dependence on interference, from which a transitional trajectory is adjusted to match the minimum trajectory through the target position.

4 Claims, 1 Drawing Sheet

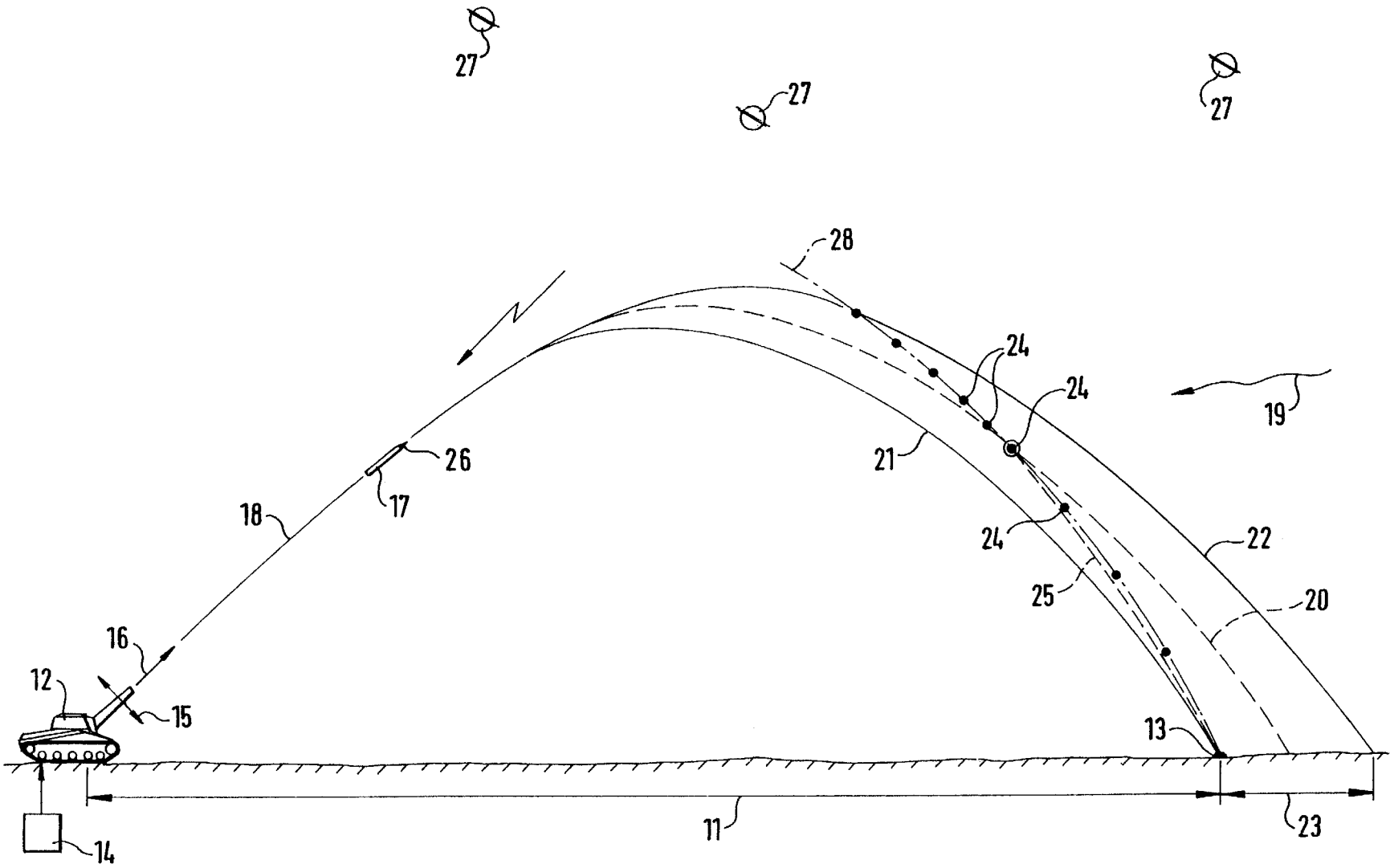
27
27
27
28
24
24
24
19
20
22
21
25
13
23
11
26
17
18
16
15
12
14

PROCESS FOR THE TARGET-RELATED CORRECTION OF A BALLISTIC TRAJECTORY

BACKGROUND OF THE INVENTION

1. Field of the Invention

The present invention relates to a process for the correction of the path of a trajectory, effected in accordance with an expected target offset, wherein the path of the trajectory is measured satellite-supportedly on board a ballistically or quasi-ballistically fired projectile by increasing its aerodynamic drag coefficient so as to cause it to turn from an initial trajectory path into a steeper transitional trajectory towards the target.

2. Discussion of the Prior Art

A process of that kind is known from WO 98/01719. It is based on a procedure of using a satellite navigational apparatus on board the projectile to determine the trajectory which is currently being followed, and, from a comparison with a target-optimised trajectory, when a point on the trajectory which is derived from the comparison is reached, releasing aerodynamic braking devices for correction with the greatest possible degree of target accuracy of the subsequent trajectory. Problems arise in terms of practical implementation however by virtue of the fact that the numerous external influencing factors acting on a trajectory path still act on the trajectory even after the braking means are released and therefore the corrected trajectory does not then result in the operative mechanism in the projectile being delivered accurately on the target.

It is known from EP 0 138 942 B1 to locate a target for example by means of radar from the cannon and to determine in the fire control computer elevation and charge for a ballistic trajectory path which extends somewhat beyond the target, then to measure the launch speed of the projectile from the barrel and shortly thereafter by means of radar to ascertain the instantaneous position of the projectile relative to the cannon. Comparison of that instantaneous position with the reference position, on the basis of the calculated ballistic trajectory path, is used to determine the target layoff which is actually to be expected, the final step being to derive therefrom when aerodynamic braking effects should be activated at the projectile such as extending braking flaps or blowing off an aerodynamic projectile tip in order to suitably reduce the remaining trajectory on the basis of the new aerodynamic conditions and thereby to reduce the layoff from the target. This procedure also again only involves comparing a real to a predetermined ideal trajectory path in order to determine the attainment of a braking time so that once again the initialisation time for the braking means is error-ridden in dependence on external influences and then the interference effects which thereafter still act on the modified trajectory necessarily result in an additional target layoff.

Such a correction measure in respect of the braked transition from an initial trajectory path into a trajectory which is optimised after the apogee thereof is all the same substantially less expensive than the installation of a target sensor, control system and regulating loop for automatic, target-seeking final approach flight of a projectile. On the other hand, in consideration of the projectile speed being high in particular in the initial phase, the procedure for determining the real trajectory path from the measurement of initial instantaneous points on the trajectory is highly imprecise. The trajectory path which is actually flown however should be known to a very high degree of accuracy in order to be able to provide for optimum timing, after the apogee, of the braking manoeuvre for reducing the trajectory for the purposes of achieving a lower degree of scatter in the target area. Another problem in regard to a ground-supported process is also the reliability of a communication link for transmitting the braking triggering time or directly the braking command from the firing control computer to the projectile as, in view of the high speed of the projectile, the projectile can fly at any event in some sections of its trajectory in an ionised atmospheric shell which adversely affects a radio communication.

SUMMARY OF THE INVENTION

In consideration of those factors, the object of the present invention is to develop the process of the general kind set forth, which in itself is promising but which is still too inaccurate for the aspects of a practical situation, in such a way that it is possible to achieve substantially more precise target acquisition by way of a reduction in trajectory, as a result of an increase in the aerodynamic braking moment.

Accordingly the procedure according to the invention is based on the notion, as is known per se as such, of reducing the longitudinal scatter, which is very much greater in comparison with transverse scatter, of a ballistically or quasi-ballistically delivered projectile, in that the holding point is firstly laid behind the measured target position and then that trajectory is shortened. However, that laying effect is now only effected to such an extent that the transitional trajectory guides the projectile precisely on to the target after braking of the projectile having regard to a current error budget, on the theoretically shortest trajectory, wherein in accordance with the invention that given error budget is determined for as long as possible along the trajectory path to the braking moment from a comparison with the trajectory path which is theoretically predicted for given error parameters.

The projectile may be for example a drive-less projectile or missile which is fired from a mortar or from a howitzer, but also for example an artillery rocket with its rocket motor which acts to increase the range initially along a quasi-ballistic trajectory. The real transitional trajectory into which the projectile is then moved from its initial trajectory path by means of the aerodynamic braking effect lies between the flattest or shortest (minimum) and the highest or longest (maximum) trajectory of the current scatter fan or range and in principle can be converted by the braking action into the shortest trajectory, that is to say the trajectory which leads directly to the target.

Determining the current trajectory path does not involve having recourse to the procedure for determining the trajectory from the cannon, which is inevitably really inaccurate and technically unreliable due to interference effects. On the contrary, as is known per se, the initialisation point for the braking manoeuvre is autonomously determined on board the projectile, without therefore also being reliant for that purpose on a data link to a ground station. For that purpose the projectile is again equipped with a satellite receiving device for determining the actual initial trajectory path. As a deviation from the state of the art of the general kind set forth, the braking manoeuvre however is now not already triggered when a predetermined point on the trajectory is reached, but in accordance with the invention the initial trajectory path is compared to the theoretical launch curve over a period of time which is as long as possible, for as many trajectory points as possible. The build-up of the trajectory deviations which are ascertained therefrom, system-governed determining factors and preferably additionally measurements by sensor means for example on board the projectile and/or from the ground, such as in particular in accordance with DE 41 20 367 A1, are used as the basis for parametric determination of the current interference influences. These are in particular wind directions and strengths at different heights but also for example the error budget of the launch device (known transverse and heightwise aiming inaccuracies of the cannon) and influences of the intensity of the launch or firing charge, which varies depending on environmental considerations. With such knowledge, it is then possible by means of the usual external-ballistics approaches to pre-calculate really accurate information about the interference effects which even after release of the braking means still continue to act on the transitional trajectory which the projectile then follows, in order to compensate for those error influences to be expected as far as possible in advance by correction of the braking time. In order to obtain as much information as possible for the purposes of determining the current error budget, the braking time is as late as possible. Thus ultimately it is not defined in dependence on the launch of the projectile but in dependence on the remaining flight time to theoretical attainment of the target. It is therefore determined rearwardly in respect of time, so-to-speak in opposite relationship to the temporal motion along the trajectory.

In order to require as little flight time as possible for contacting the navigational satellites from the projectile, and in particular to cause the procedure for determining the real trajectory path to begin as soon as possible after projectile launch, the projectile is also given an item of information about the trajectory path which can be calculated for the instantaneous already known error budget, that is to say the currently ideal trajectory path, and about the satellite contacts which are to be expected therefrom. In that way it is possible very rapidly to access from on-board the projectile at least some of the navigational satellites which are above the horizon and rapidly obtain reliable information about the actual (real) trajectory path, that is to say also the deviation thereof from the trajectory which is predetermined by calculation, in order to infer therefrom the actual current error influences.

The greater the number of current trajectory points that can be measured on board the projectile by means of satellite navigation, the correspondingly more accurately is the trajectory path determined up to the time of initiation of the braking manoeuvre beyond the apogee, and the correspondingly more accurately is it therefore also possible to determine on board the layoff which is to be expected therefrom, from the conventionally measured moment which is communicated upon launch to the projectile. That makes it possible to suitably accurately predetermine the ideal initialisation point for initiation of the braking procedure, that is to say for entry into the transitional trajectory which is determined by the new aerodynamic conditions, from the real trajectory which has been predetermined as being too far, into the minimum, accurately targeted trajectory, in dependence on the remaining flight time into the target area. Because on the other hand that braking time which is as late as possible can be accurately determined, satellite tracking can be used for updating the knowledge about the real trajectory into the directly time proximity of the activation point for the braking manoeuvre, that is to say it can also be extended correspondingly long beyond the apogee, which results in a further improvement in determining the externally influenced real trajectory into the closest possible proximity to the target, and thus affords knowledge about the interference influences until close before the target. When then, on the real trajectory which is very accurately determined by continuous updating, for the currently prevailing error influences, the last possible initialisation point for entry into the braked transitional trajectory for the approach to the minimum trajectory is directly imminent, the structurally predetermined braking manoeuvre is triggered for example by extending braking elements or blowing off the aerodynamic projectile tip and therefore target acquisition is achieved with a high degree of reliability in the final approach flight phase, on the minimum trajectory or at any event on a trajectory which leads very close to the target.

In order to minimise the computation complication and expenditure for determining the optimum (latest possible) braking triggering point on board the projectile, desirably trajectory co-ordinates of an array of real trajectories which are to be expected, between the maximum and the minimum trajectories, and which are also displaced out of the pure trajectory parabola for example under wind influences or due to other interference influences, are stored in the form for example of look-up tables for example from the firing control computer in the processor on board the projectile; and in addition, as the triggering curve, the sequence of ideal, that is to say latest possible initialisation points over the remaining transit time of the respective trajectory of that array. For the current real trajectory within that array, which is then currently very accurately determined from satellite navigation, only the immediately imminent point of intersection of the currently flown, real trajectory with that triggering curve now still needs to be predicted, in order then to enable triggering of the braking effect for the transition into the accurately targeted minimum trajectory.

BRIEF DESCRIPTION OF THE DRAWINGS

Additional alternatives and developments as well as further features and advantages of the invention will be apparent from the single FIGURE of drawings and from the description hereinafter of a preferred embodiment for carrying the process according to the invention into effect, which is diagrammatically shown in greatly abstracted form in the drawing but not true to scale, being limited to what is essential. The single FIGURE of the drawing is a view in longitudinal section showing the principle of firing a ballistically launched projectile from a cannon on to a target along a trajectory which in the final approach flight phase is braked from the real trajectory into the minimum trajectory, that is to say the trajectory which is braked in target-optimised fashion; with the initialisation point for the transitional trajectory being determined from a continuous satellite-supported trajectory-determining procedure on board the projectile.

DETAILED DESCRIPTION OF A PREFERRED EMBODIMENT

Depending on the previously established direction and range 11 from a cannon 12 to a target 13, azimuth orientation, elevation 15 and propellent charge power (that is to say the theoretical muzzle velocity 16) for the ballistic trajectory path 18 of a projectile 17 into the target region are determined in a firing control computer 14. That calculated launch trajectory path 18, after the apogee, makes a transition into a trajectory 20 which is between a minimum trajectory 21 and a maximum trajectory 22 for a given error budget in the area around the target 13 which is actually to be acquired, that is to say within a certain longitudinal scatter or spread 23 of the possible impact points in the target region. By virtue of systematic and use-related error influences such as inaccurate elevation 15, a muzzle velocity 16 which actually differs from the preset value and for example wind influences 19 which differ in strength and direction in dependence on height, the real trajectory 20 does not actually coincide with that which follows from the calculated trajectory parabola for the trajectory path 18, but it increasingly more or less deviates therefrom. Because a trajectory 20 cannot be extended but can only be shortened by aerodynamic braking influences, the projectile 17 is equipped with an aerodynamic braking device which in per se known manner for example can involve braking surfaces which can be extended by a folding or pivotal movement or a releasable flattened projectile front member, see also the radially spreadable braking sail for trajectory curtailment, in accordance with DE 3 608 109 A1.

For the braking system 26 which is specifically present and for certain interference influences, associated with a real trajectory 20 is an initialisation time 24 which is ideal in relation to the remaining flight time to the target 13 and from which the projectile can divert from the real trajectory 20 precisely into such a transitional trajectory 25 that the latter increasingly approaches the minimum trajectory 21 and at any event theoretically finally goes accurately to the target 13. That initialisation point 24 occurs correspondingly earlier on the real trajectory 20, the further away the trajectory 20 would be from the target 13 in the plane of the target region, without the braking correction intervention, that is to say the correspondingly higher that the trajectory 20 is. This means that, for an array of possible real trajectories 20, a sequence of the ideal initialisation points 24 can be represented as a triggering curve 28 which (as can be seen from the drawing) is pivoted somewhat with respect to a set of curves of real trajectories 20, which therefore respectively intersects once the entirety of the real trajectories 20 between the minimum and the maximum trajectories 21–22. The various interference influences (such as the wind data 19) can be parameterised by a set of differently inclined arrays of trajectories 20 and/or by a set of differently extending triggering curves 28.

In that way the directly imminent attainment of the initialisation point 24 which is ideal for a given launch trajectory path 18 under the current interference conditions can be really accurately predicted because the disturbed real trajectory 20 is really accurately known.

The procedure for determining the currently real trajectory 20 (and therefrom then the procedure for establishing the attainment of the initialisation point 24) is effected on board the projectile 17 itself over a flight path section which is as long as possible in order to detect the real effect of as many error influences as possible on the trajectory path 18 into the trajectory 20. The operation of determining the trajectory is implemented with satellite support, that is to say by way of the reception of the items of positional information from navigational satellites 27 which are currently detected on board the projectile 17, on the basis of the known orbit data thereof, as is generally known as such from satellite navigation by means of different systems of locating satellites. For that purpose the spin-stabilised projectile 17 is preferably provided with scanning, which rotates in opposite relationship to the spin, of antenna elements which surround the projectile 17 on its peripheral surface in order to permit interference-free direct reception, that is to say to cut out interference ground reflection phenomena in respect of satellite radiation, as described in greater detail in EP 0 840 393 A2.

In order to be able to switch to the satellites 27 as quickly as possible, that is to say to achieve a close succession, which is initiated as early as possible, of real trajectory co-ordinates for determining the actual trajectory path 18 and the trajectory 20 resulting therefrom, expected values in terms of the positions of probably receivable satellites 27 are also given to the projectile 17 from the firing control computer 14 upon launch for the launch trajectory 18 which is predetermined by computation, those values then serving as a basis after launch on board with continuous updating. In addition, sequences of initialisation points 24 for disturbed arrays of possible real trajectory paths 20 are stored as an interference-dependent set of triggering curves 28 in the processor on board the projectile 17, for the purposes of prediction of the initialisation point 24.

When now the stored ideal initialisation point 24 is reached, having regard to the current interference influences on the real trajectory 20 which is really accurately determined by means of satellite navigation, the braking device 26 is activated and the projectile departs from the previous real trajectory 20, turning into the transitional trajectory 25 to the target 13.

In order therefore to perceptibly reduce the inevitable trajectory scatter or spread of projectiles 17 which are ballistically fired into the target area without the technological expenditure involved in automatic target-seeking control, and in order thereby substantially to improve the level of target hit accuracy, the minimum trajectory path 21 is laid through the previously ascertained target position 13—having regard to the error budget of the weapon 12 and the external influencing parameters to be expected such as a height-dependent headwind 19 on a real trajectory 20—so that all real trajectories 20 up to the maximum trajectory 22 of that overall error budget are behind the target position 13. The descent of the projectile 17 into the target area is then shortened from the instantaneous real trajectory 20 to the minimum trajectory 21, that is to say towards the target position 13, by the enablement of an aerodynamic braking effect. For that purpose, attainment of the optimum initialisation point 24, which is dependent on the theoretical remaining flight time, for the aerodynamic braking device on the projectile 27 is determined on the real trajectory 20 by a procedure whereby in accordance with the invention the real trajectory 20 is now continuously measured by means of satellite navigation over a distance which is as long as possible to directly prior to the point of intersection with a triggering curve 28 which is predetermined in dependence on environmental factors—and therefore as far as the conclusion, with all actual error influences being involved. Thus, the actual approach to the point of intersection with the triggering curve 28, that is to say the sequence of optimum initialisation points 24—24 for the array of real trajectories 20/20, is established, from which a braked transitional trajectory 25 is adjusted to match the minimum trajectory 21 through the target position 13.

What is claimed is:

1. A process for a satellite-assisted correction of the path of a trajectory of a ballistically or quasi-ballistically fired projectile, the trajectory path being measured in conformance with an expected offset from a target by an increase in the aerodynamic drag coefficient of the projectile causing said projectile to divert from an initial trajectory segment into a steeper transitional trajectory segment towards the target, wherein external disruptive influences acting on the configuration of the trajectory path are taken into consideration in a predictive determination of an imminent real trajectory beyond the target by, selectively, sensor means and the measured trajectory path in comparison with a computationally derived trajectory, wherein for the expected real trajectory, on the basis of said external disruptive influences, there is determined an initiating point as closely as possible preceding the target for effecting an increase in the aerodynamic drag coefficient causing entry into said steeper transmittal trajectory segment so as to turn the projectile into an accurately targeted minimum trajectory segment.

2. A process according to claim 1, wherein for an array of error-dependent previously specified real trajectories between the minimum trajectory segment leading to the target and a maximum trajectory segment beyond the target, there is stored a triggering curve of a sequence of initiating points on board the projectile, and an imminent point of intersection of the triggering curve with the measured real trajectory is determined from an ongoing satellite navigation for triggering a braking device on said projectile.

3. A process according to claim 2, wherein external disruptive influence-dependent arrays of curves for selectively real trajectories and for said triggering curves are stored in the projectile.

4. A process according to claim 1 or 2, wherein initial positions are predetermined for the projectile upon launch into the real expected trajectory segment pursuant to expected contacts with navigational satellites for implementing the trajectory measurement.

* * * * *